US006891458B2

(12) United States Patent
Hyatt Jr. et al.

(10) Patent No.: US 6,891,458 B2
(45) Date of Patent: May 10, 2005

(54) ELECTRONIC CAM ASSEMBLY

(76) Inventors: Richard G. Hyatt Jr., 2720 Timber Rd., Shawsville, VA (US) 24162; Douglas E. Trent, 5544 Crescent Blvd., SW., Roanoke, VA (US) 24014

( * ) Notice: Subject to any disclaimer, the term of this patent is extended or adjusted under 35 U.S.C. 154(b) by 311 days.

(21) Appl. No.: 09/822,852

(22) Filed: Apr. 2, 2001

(65) Prior Publication Data

US 2001/0040492 A1 Nov. 15, 2001

Related U.S. Application Data

(63) Continuation-in-part of application No. 09/092,080, filed on Jun. 5, 1998, now Pat. No. 6,209,367.

(60) Provisional application No. 60/050,941, filed on Jun. 6, 1997.

(51) Int. Cl.[7] ..... H01F 5/00

(52) U.S. Cl. ..... 335/267; 335/259; 70/277

(58) Field of Search ..... 335/220–229, 335/250–251, 254–259, 263–269; 292/144; 70/277–279.1, 106, 279, 116

(56) References Cited

U.S. PATENT DOCUMENTS

| | | | | |
|---|---|---|---|---|
| 1,817,592 A | | 8/1931 | Sokoloff | |
| 2,946,875 A | | 7/1960 | Waldhauer, Jr. | |
| 3,344,377 A | | 9/1967 | Clements | |
| 3,914,723 A | | 10/1975 | Goodbar | |
| 3,961,298 A | | 6/1976 | Jaffe et al. | |
| 4,288,944 A | * | 9/1981 | Donovan | 49/395 |
| 4,503,411 A | | 3/1985 | Lofstrand | |
| 4,656,850 A | * | 4/1987 | Tabata | 70/276 |
| 4,671,086 A | | 6/1987 | Fogleman et al. | |
| 4,682,133 A | | 7/1987 | Kern | |
| 4,800,741 A | * | 1/1989 | Kerschenbaum et al. | 70/13 |
| 5,435,343 A | | 7/1995 | Buezis | |
| 5,717,372 A | | 2/1998 | Cannon et al. | |
| 5,734,310 A | | 3/1998 | Ankney et al. | |
| 6,002,184 A | | 12/1999 | Delson et al. | |

FOREIGN PATENT DOCUMENTS

| | | |
|---|---|---|
| GB | 2 221 714 | 7/1990 |
| GB | 2 226 593 | 7/1990 |
| GB | 2 250 052 | 7/1990 |
| GB | 2 259 737 | 7/1990 |
| GB | 2 243 185 | 10/1991 |

* cited by examiner

*Primary Examiner*—Lincoln Donovan
(74) *Attorney, Agent, or Firm*—Robert E. Bushnell, Esq.

(57) ABSTRACT

A lock may be constructed with a locking mechanism that uses either a cam assembly with a cylinder plug perforated by a centrally positioned keyway or a cylinder plug. The locking mechanism may be equipped with a dual armature solenoid. With the dual action solenoid constructed with a single wire coil, the distal ends of coaxially aligned armatures engage opposite axially aligned detents to maintain the lock in its locked state, while application of a potential difference across the coil draws both armatures away from their corresponding detents and toward the bore of the coil, thereby placing the lock into its unlocked state.

38 Claims, 11 Drawing Sheets

ELECTRONIC CAM ASSEMBLY

CLAIM FOR PRIORITY

This application makes reference to, incorporates the same herein, and claims all rights accruing from our earlier filing of a provisional patent application entitled Electronic Cam Assembly filed in the United States Patent & Trademark Office on the 6$^{th}$ day of Jun. 1997 and there assigned Ser. No. 60/050,941, and our patent application entitled ELECTRONIC CAM ASSEMBLY filed in the United States Patent & Trademark Office on the 5$^{th}$ day of Jun. 1998 and there assigned Ser. No. 09/092,080, now issued on the 3$^{rd}$ of Apr. 2001 as U.S. Pat. No. 6,209,367.

BACKGROUND OF THE INVENTION

1. Field of the Invention

The present invention relates to access control, and, more particularly, to manually operated, electronically keyed locks and locking processes suitable for retrofitting existing appliances.

2. Description of the Related Art

Current designs for maintaining security of containers such as bank safe deposit boxes require attended access and, all too frequently, dual keys, to allow access to the various containers maintained. We have found that the use of dual keys has become increasingly expensive in terms of man hours consumed by the employees of the bank providing attendance to the customers of the bank. Historically, safe deposit locks as well as other locks, have used a keyed cylinder that is offset from the centerline of the casing for the lock, within the body immediately behind the front plate of the safe deposit door. It was the object of this design to accommodate a full sized set of mechanical tumblers within the casing immediately behind the front plate of the door. The economics of safe deposit box rental require that the casing of the lock be made narrow in order to provide a high degree of security for the door while minimizing the loss of volume of the door due to the presence of the casing for the lock. The offsetting of the centerline of the keyway in turn allows the use of a more conventional and secure design within the very narrow compartment doors, as well as within taller doors. By the expedient of placing the cylinder of the lock in the lower portion of the casing, below the centerline of the casing and vault, the key could lift a set of larger tumblers without requiring an undesirably larger lock casing. The economy of providing uniform lock design, over the years, for differing applications has resulted in an existing installed base of millions of these locks. While not all of these locks rely upon offset keyed cylinders (referred to as "noses" in the trade), many do.

Four major lock manufacturers currently continue to produce locks with offset keyed cylinders, while at least two other manufacturers that have discontinued production, continue to have a large installed base. One of the most popular offset locks in the current market is the 4440 series left hand and right hand model manufactured by Sargent And Greenleaf. We have noticed a need to retrofit existing offset keyed cylinder locks with electro-mechanical locks, without expensive and inconvenient replacement of the doors, in order to minimize the man hours consumed by employees of banks that provide attendance to the customers, while the customers open their safe deposit doors, with a mechanical enhancement of blocking strength as well as an improvement of security over other processes, without a complex electrical contact system.

We have also noticed that authorized service mechanics often open locked mechanical safe deposit locks by first drilling a hole through the face of the cylinder plug, threading a sheet metal or self tapping screw into the hole and pulling the inserted screw with either a nose puller or claw hammer until the face of the cylinder breaks away to allow removal of the cylinder plug. The removal of the cylinder plug allows direct and immediate frontal manipulation of the tumblers until the lock is unlocked. Consequently, even though the faceplate of the safe deposit door may itself be strong enough to resist casual tampering, the susceptibility of the cylinder plug to quick removal by a single application of brute force deleteriously reduces the security of the entire drawer.

The Electronic Security System of U.S. Pat. No. 5,745,044 and U.S. Pat. No. 5,140,317 issued to Hyatt et al., is currently used to lock pay telephones. This design blocks a locking bolt, but does so from what we believe is a geometrically disadvantageous point. By virtue of the separate direct blocking of a bolt by a solenoid, the bolt is blocked off center from the centerline of the bolt. Moreover, the physically large lock cylinder and the inter-device discrete wiring between the solenoid and the other components inside the casing, as well as the electrical contact system for the lock cylinder, create several problems in our opinion. Furthermore, the difficulty of manufacture and installation of wiring, and the absence of both miniaturization and offsetting of the bolt blocking, suggest that there is little practical prospect of retrofitting the many existing offset nose locks. In addition, the routing and use of discrete wires causes problems of reliability and quality during manufacture and usage, absent tedious careful and consistent monitoring.

The rotatable keypad operated solenoid lock of Butterweck, et al, U.S. Pat. No. 5,845,523 for an Electronic Input And Dial Entry Lock, and the other various locks mentioned in that patent such as U.S. Pat. No. 4,831,851 for a Combination/electronic Lock System by Larson, U.S. Pat. No. 4,967,577 for an Electronic Lock With Manual Override by Gartner, et al, U.S. Pat. No. 4,899,562 for an Electronic Door Lock by Gartner, and U.S. Pat. No. 4,904,984 for a Combination Lock With An Additional Security Lock by Gartner, are variations of a dial operated combination lock, and lack the security, reliability and economy traditionally demanded for safe deposit boxes and drawers, while the Lock For A Safe-Deposit Box of Chieh-Chen Yen, et al., U.S. Pat. No. 5,495,733 inconveniently relies upon different keys for the renter of the safe deposit box and for the clerk of the bank, as well as a manually operated keypad.

Generally, we have noticed that many of these locks remain susceptible to mechanical tampering. By way of example, we have the tolerances of some of these locks have a configuration that translates a force that is externally applied to the casing of the lock to translate that force into an inertia that causes a locking component such as a pin, latching mechanism, detent or sidebar to travel in the opposite direction from its locked position, and to be temporarily disengaged from whatever groove, recess or slot it occupied prior to application of the force. This allows a torque that was contemporaneously applied to the lock to operate the lock, such as by rotating the cylinder plug within the shell of the cylinder.

SUMMARY OF THE INVENTION

It is therefore, an object of the present invention to provide an improved lock and process for restricting access to containers.

It is another object to provide a lock and process suitable for retrofitting containers previously secured by bitted and unbitted locks.

It is yet another object to provide a lock and process able to enhance the security of containers against unauthorized entry.

It is still another object to provide a lock and process able to electronically control access to the interior of secured containers.

It is still yet another object to provide a lock and process for electronically monitoring access to secured containers.

It is a further object to provide an electronically key controlled process and a cam assembly that may be configured as a single integrated electromechanical unit operable with an electronically controlled key, mated with either the existing lock cylinders of containers or with new lock cylinders, and retroactively fitted to secure those containers.

It is a still further object to provide an electronically key controlled process and integrated electromechanical cam assembly that may either be installed as a retroactively fitted component part of an existing locking mechanism with a minimum of modifications of the locking mechanism, or alternatively, be incorporated into a complete locking mechanism.

It is still yet a further object to provide an electronically key controlled process and integrated electromechanical cam assembly that may be retroactively installed as a component part of locking mechanisms previously installed in lockable containers by using existing screw patterns and key holes of those containers.

It is an additional object to provide an electronically key controlled process and integrated electromechanical cam assembly able to be mated with either bitted lock cylinders or with unbitted cylinder plugs.

It is still an additional object to provide an electronic cam and cam locking process endowed with simplified interconnections between the components of the lock, and that is amenable to simplified manufacture.

It is yet an additional object to provide an electronic cam and cam locking process endowed with an enhanced mechanical strength.

It is still yet an additional object to provide an electronic cam and cam locking process that indirectly blocks the cam.

It is also an object to provide a locking cam and cam locking process that drives and locks the bolt from its relative center.

These and other objects may be achieved with a process and a lock for securing access to the interior of a volume. The lock may be constructed with a housing bearing an interior recess containing a pair of axially aligned and spaced apart detents. A locking mechanism is removably inserted within the recess. The locking mechanism may be constructed with a single annularly wound coil of insulated wire to form a circular cylinder surrounding a central axially oriented bore, with the wire terminated by a single pair of leads. The bore perforates axially opposite base ends of the coil. A pair of armatures made of a material that is movably responsive to magnetic force, each exhibit a distal end. The armatures are both slidably positioned at axially opposite ends of the bore, in coaxially aligned axial opposition. One or more springs are coaxially aligned with the armatures, to bias both armatures to extend their distal ends axially outwardly beyond axially opposite base ends of the coil.

The housing of the lock may be positioned to control access by alternately assuming a locked state and an unlocked state. The housing holds the locking mechanism with its bore axially aligned between the pair of detents, so that the detents provide simultaneous engagement of the distal ends of the armatures and maintaining the lock in its locked state. When a potential difference is applied across the leads of the coil, the distal ends both withdraw axially away from their engagement with the detents and travel towards the bore to place the lock in its unlocked state and thereby allow access to the interior of the volume secured by the lock.

When the mechanism is incorporated into the body of a lock, by electrically energizing a release mechanism that is spaced-apart from the axis of rotation of the cylinder plug, the magnetic field created by the coil within its bore draws the coaxially aligned armatures in opposite directions toward the centroid of the bore; consequently, both armatures move between a deployed position preventing rotation of the cam or cylinder plug of the lock relative to the housing, and a released position accommodating the rotation of the cam or the cylinder plug relative to the housing.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
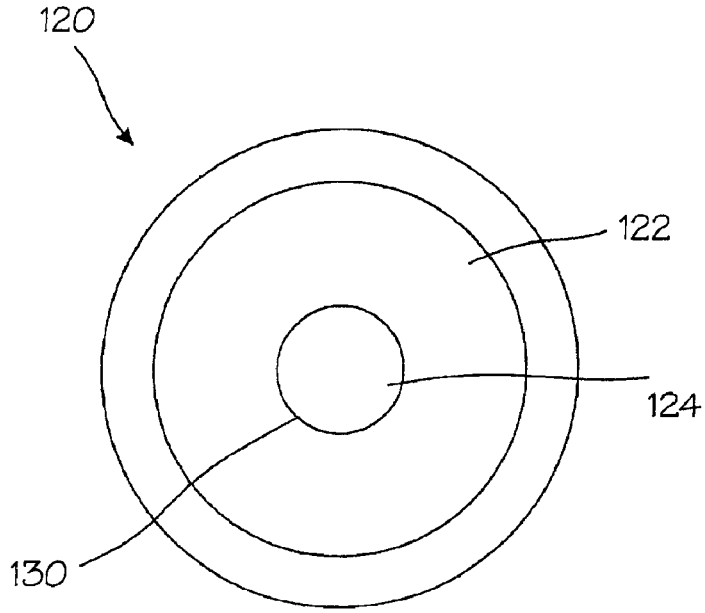
FIG. 1 shows an end view of the embodiment of the present invention.
Figure 2:
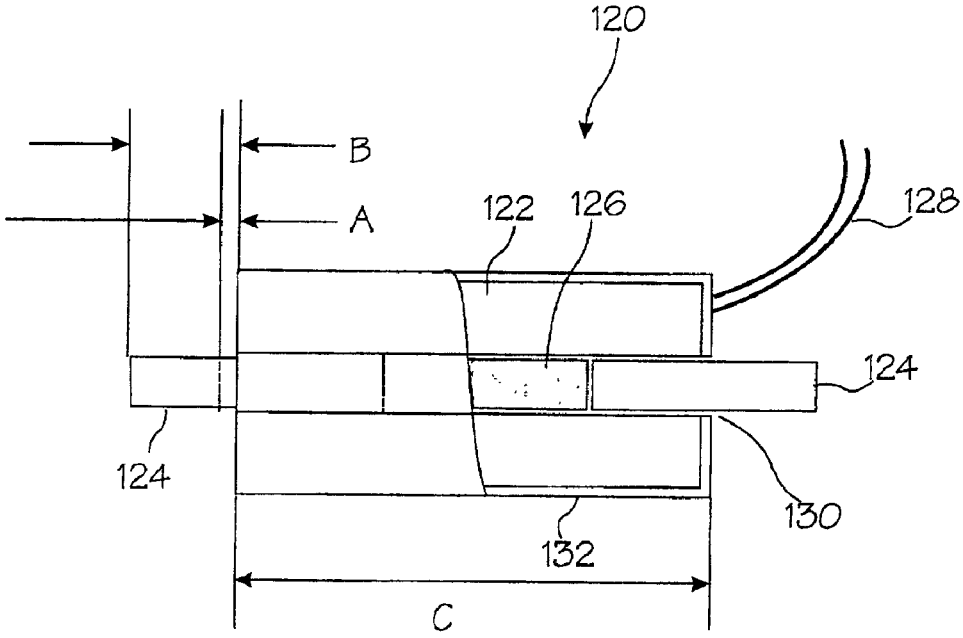
FIG. 2 shows a partially cut-away side of elevational view of the embodiment illustrated by FIG. 1.

Turning now to the drawings and specifically to FIGS. 1 and 2, solenoid 120 may be used in a cam lock, for example, to block movement of a bolt of the lock from an extended position in which rotation of the cam is blocked, to a retracted position in which the bolt is withdrawn and the rotation of the cam is accommodated. In such constructions solenoid 120 would block operation of the lock with oppositely extending coaxially positioned armatures 124 that are coaxially aligned along the central axis formed by a single winding of coil 122. Coil 122 may be constructed from a single length of insulated, electrically conducting wire that is circularly wound in multiple turns to form a circular cylinder providing a central, axial bore 130 that extends the axial length of coil 122 and perforates opposite base ends of coil 122. A spring 126 may be positioned within the axial bore 130 between the adjacent proximal ends of armature 124. Spring 126 biases armature 124 to extend axially outwardly beyond the casing 132 surrounding winding 122. A pair of electrical leads 128 conduct direct current to opposite ends of the coil formed by winding 122.

A prototype of the embodiment shown in FIGS. 1 and 2 has been constructed with an overall length C between opposite base ends of casing 132 of 0.750 inches. In its rest, or relaxed state with the distal ends of armatures 124 axially extending from the bore 130, each armature 124 extends by distance B, typically 0.130 inches, beyond the corresponding base end of casing 132. With coil 122 in an energized state however, solenoid 120 withdraws both armatures axially inwardly, so that the distal ends of armature 124 extends by distance A typically 0.050 inches beyond the corresponding base end.

Figure 3:
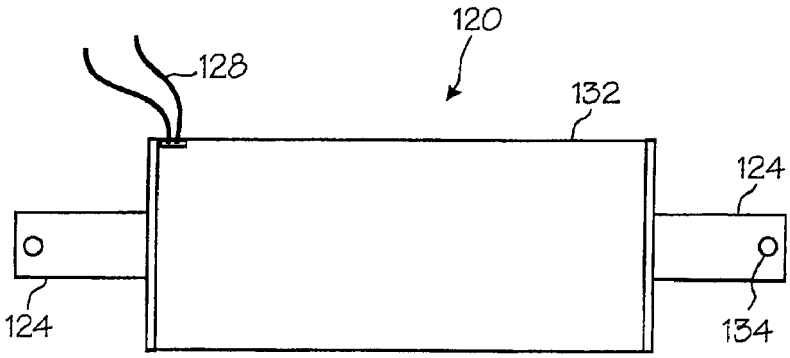
FIG. 3 shows a side elevational view of an alternative embodiment of the present invention.

FIG. 3 illustrates the compactness of solenoid 120 while in its rest state with its single coil 122 unenergized. Consequently, both armature 124 extend axially outwardly to their maximal length.

Figure 4:
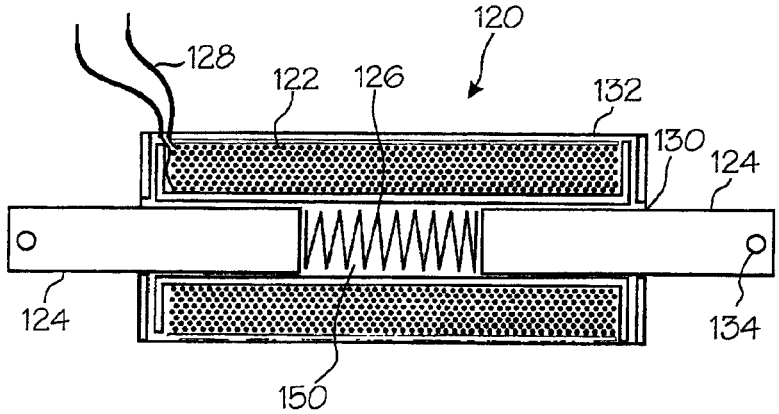
FIG. 4 shows a side sectional view of the embodiment illustrated by FIG. 3, in a first operational state.
Figure 5:
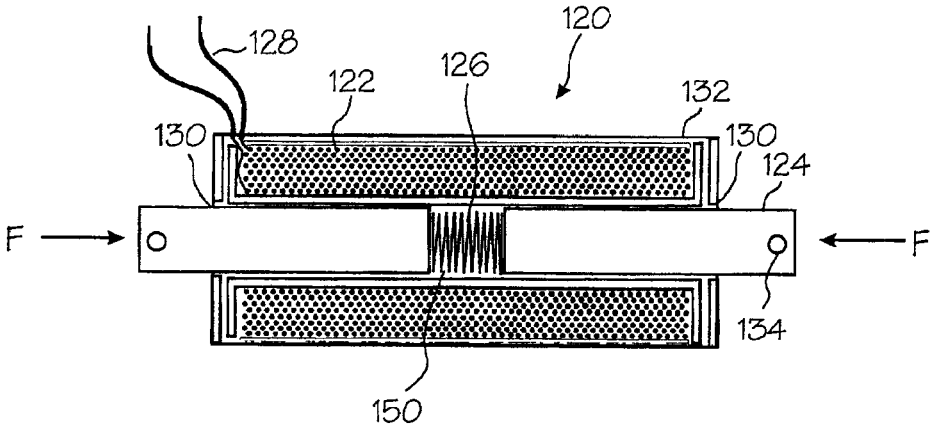
FIG. 5 shows a side sectional view of the embodiment illustrated by FIG. 3, in a second operational state.

FIG. 4 provides a cross-sectional view of solenoid 120 while coil 122 is in a non-energized state with no electrical current flowing through leads 128. Consequently, spring 126 positions within the central portion 150 of axial bore 130. The axial force created by spring 126 forces armature 124 to extend axially outwardly, is shown in FIG. 4. When coil 122 is energized by a direct current applied across leads 128, the resulting electrical filed creates oppositely directed axial force F that withdraws armature 124 into central bore 130, thereby compressing spring 126. When flow of electrical current through winding 122 is interrupted such as when electrical potential is removed from across leads 128, compressed spring 126 forces armature 124 axially outwardly from their positions shown in FIG. 5 to their positions shown in FIG. 4.

Coil 122 may be wound upon electrical bobbin 134 that defines the circular area and axial length of central bore 130. Apertures 134 in the distal ends of armature 124 may be used to attach the distal ends of armature 124 to other components. Alternatively, stops may be placed in apertures 134 to block the axial motion of armature 124 and thereby prevent the distal ends of armature 124 from entering into axial bore 130.

Figure 7:
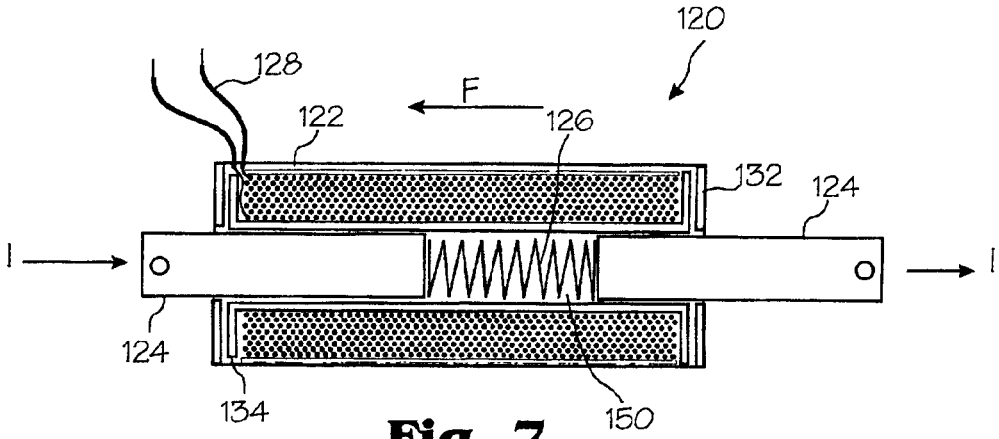
FIG. 7 illustrates the fact of inertial force applied to one side of a double armature solenoid constructed with no barrier between armatures.

Turning now to FIG. 7, when an externally generated force F is applied to casing 132 of a single armature solenoid 120 and inertia I is created that forces armature 124 in opposite direction axially into the central bore of solenoid 120, against bias of spring 126. This causes retraction of the distal end of armature 124. Consequently, force F may be used to cause an unauthorized opening of a lock if an inertia causes sufficient retraction of the distal ends of armature 124.

Figure 8:
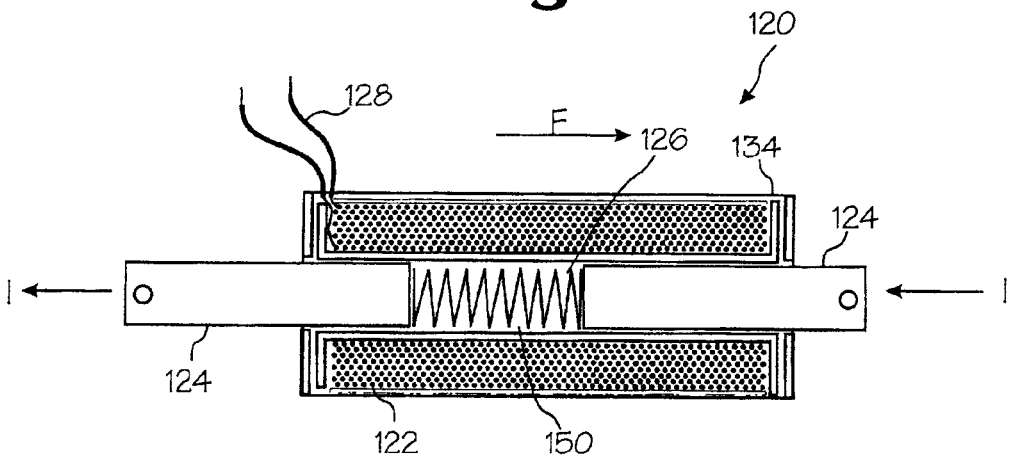
FIG. 8 illustrates the effect of inertial force applied in the direction opposite to that shown in FIG. 7, to a double armature solenoid constructed with no barrier between armatures.

The dual armature solenoid 120 shown in FIGS. 7 and 8 responds to application of an externally generated force to casing 130 by allowing the inertial force I to force both armatures 124 in the direction opposite to force F; consequently, one armature 124 is directed inwardly to a partially retracted position while spring 126 responds to the axial motion of that armature by forcing the opposite armature 124 to extend outwardly, as shown in FIGS. 7 and 8. This assures that the distal end of one of two armatures 124 extends axially outward. If solenoid 120 is incorporated into a cam lock, or other locking mechanism, application of an unauthorized force N will, at best cause a partial retraction of only one of two armatures 124, will simultaneously force the axially opposite armature 124 to be displaced more securely into its conforming detent to prevent an unauthorized opening of the lock such as by obstructing the rotation of a cylinder plug within the shell of the lock.

Figure 6:
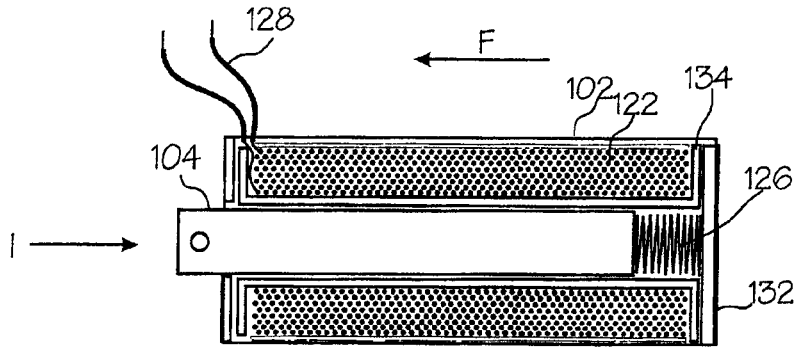
FIG. 6 illustrates the fact of inertial force when applied to a single armature solenoid.
Figure 9:
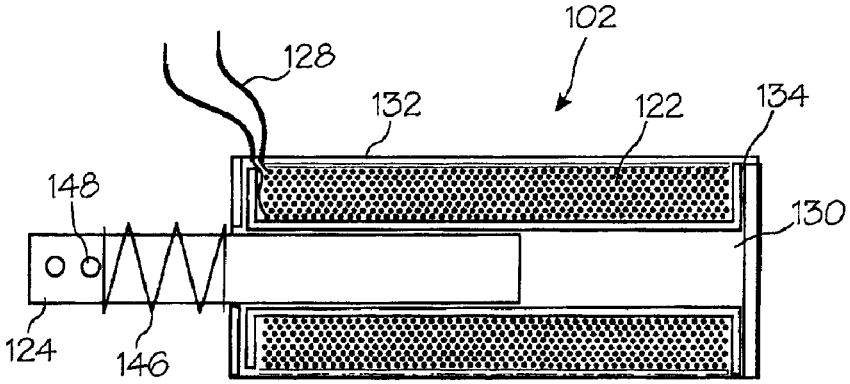
FIG. 9 illustrates a single armature solenoid constructed with an external spring.

FIG. 9 shows a single armature solenoid 102 equipped with an external spring 146 coaxially wound around the distal portion of armature 124. A detent 148 prevents spring 146 from escaping from the distal end of armature 124, and holds spring 146 in place between detent 148 and the base of central bore 130. With this arrangement however, armature 124 is exposed to the same deficiency when external forces are applied to casing 132, as is the embodiment shown in FIG. 6 with an internal spring 126.

Figure 10:
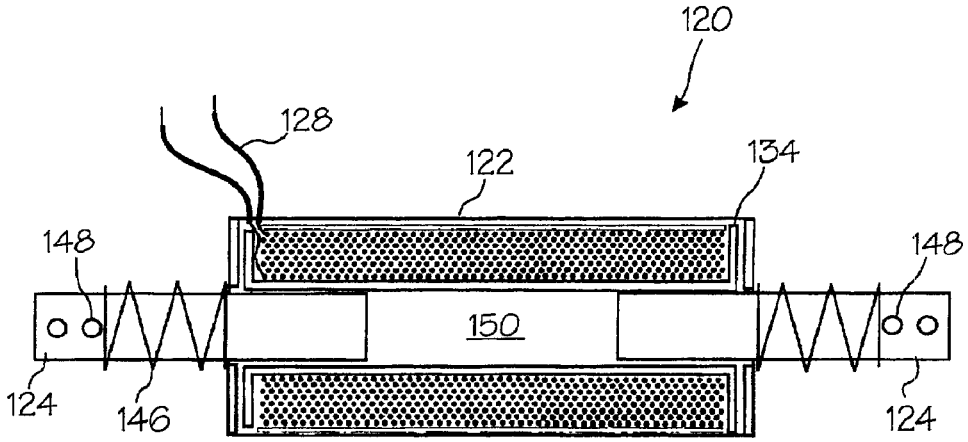
FIG. 10 is a cross-sectional view of a dual armature solenoid constructed with external springs.
Figure 11:
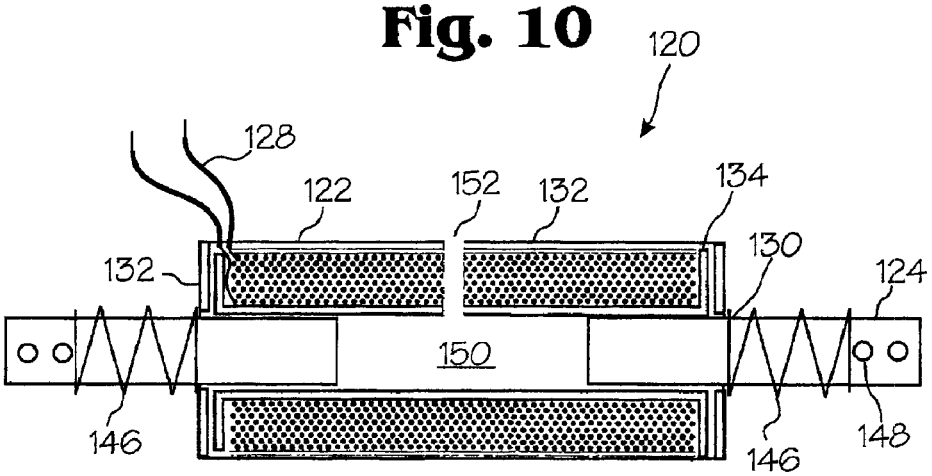
FIG. 11 is a sectional view illustrating a dual armature solenoid equipped with an air relief vent.

The embodiment illustrated in FIGS. 10 and 11 however, may be constructed with a pair of external springs 146 coaxially mounted around armatures 124. The embodiment illustrated in FIG. 11 includes an air vent 152 extending from the central portion 150 of axial bore 130, through coil 122 that opens to the atmosphere at an orifice in the circumferential exterior surface of cylinder coil casing 132. This enables armatures 124 to have a much closer exterior cylinder coil that conforms to the interior cylinder coil surfaces of axial bore 130, because air compressed within the central portion 150 by energization of coil 122 and subsequent retraction of armatures 124 will be not impeded by any increase in pressure due to air trapped within central portion 150. The closer tolerance between cross-sectional dimensions of bore 130 and armature 124 will minimize blow-by, that is ameliorated by escape of the trapped air via vent 152.

Figure 12:
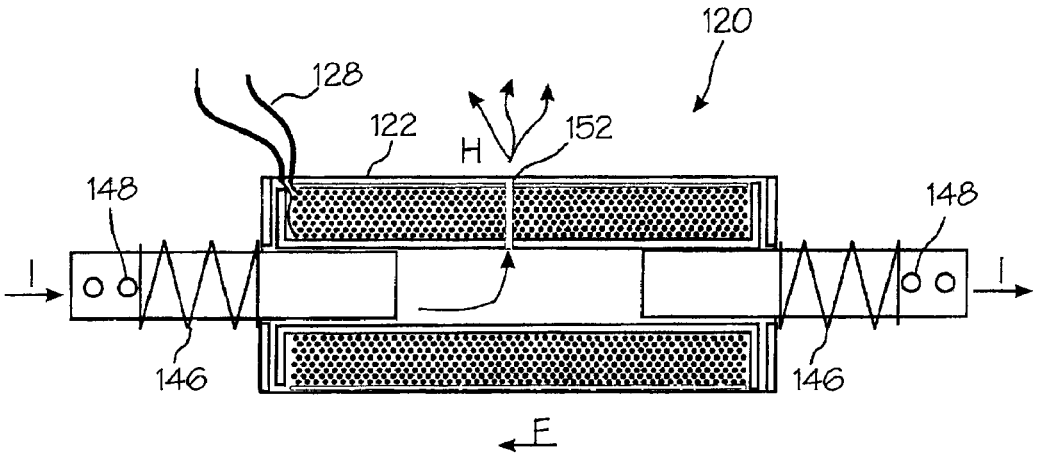
FIG. 12 is a sectional view illustrating application of external force to one armature of a dual armature solenoid equipped with external springs.
Figure 13:
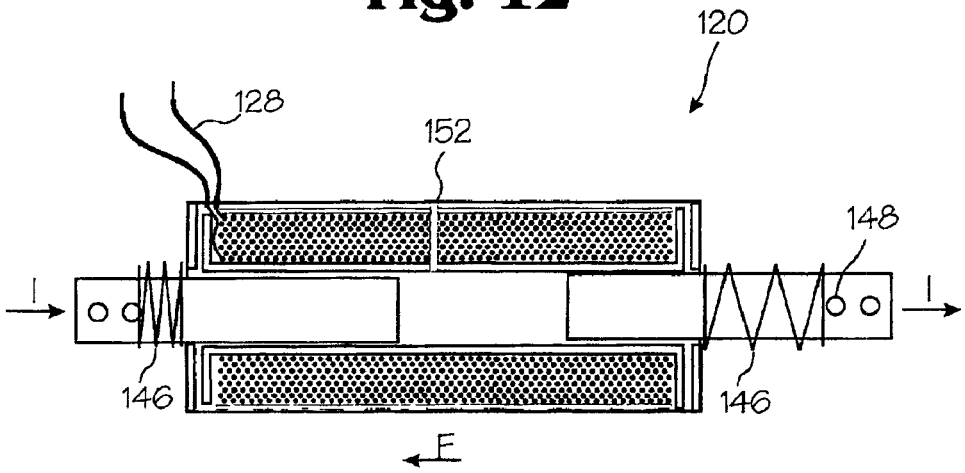
FIG. 13 illustrates the state of the embodiment shown in FIG. 12 after the external force has been removed.
Figure 14:
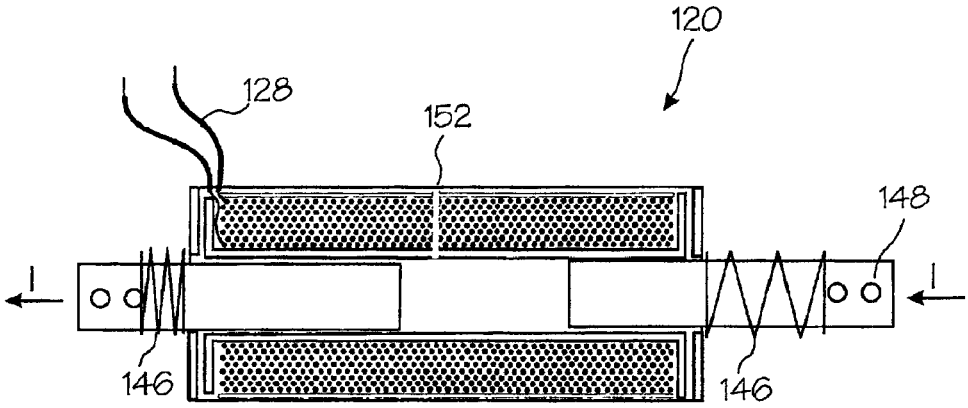
FIG. 14 illustrates the embodiment of FIG. 13 after removal of the external force applied to one of the two armatures.

FIGS. 12 and 13 illustrate that application of externally generated force F to casing 132 of solenoid 120 will result in an axially directed inertial force I that will subsequently cause a tendency of one armature 124 to recede against its surrounding spring 146, while the inertial force will force other armature 124 to extend by traveling in the same direction. Vent 152 may be sized to regulate air flow from within central portion 150.

Figure 15:
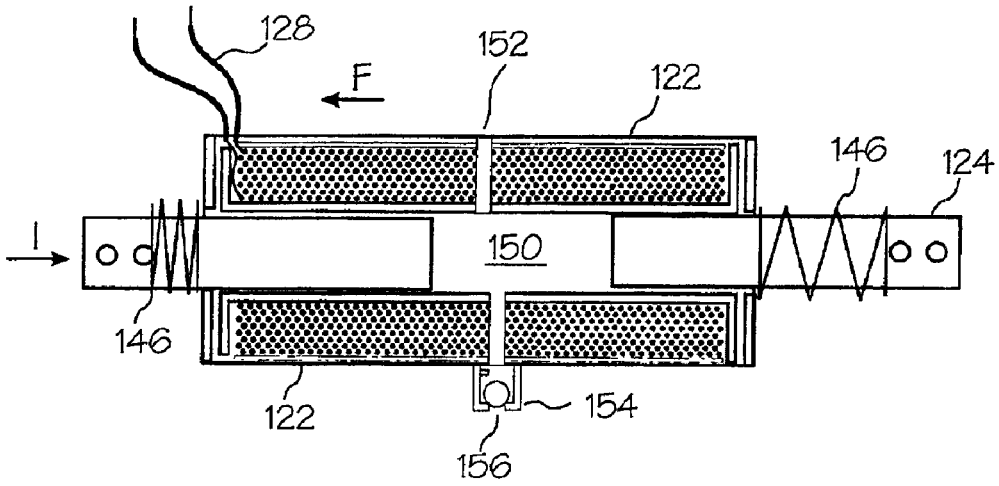
FIG. 15 illustrates an alternative embodiment of a dual armature solenoid equipped with a check valve on one of the air vents.
Figure 16:
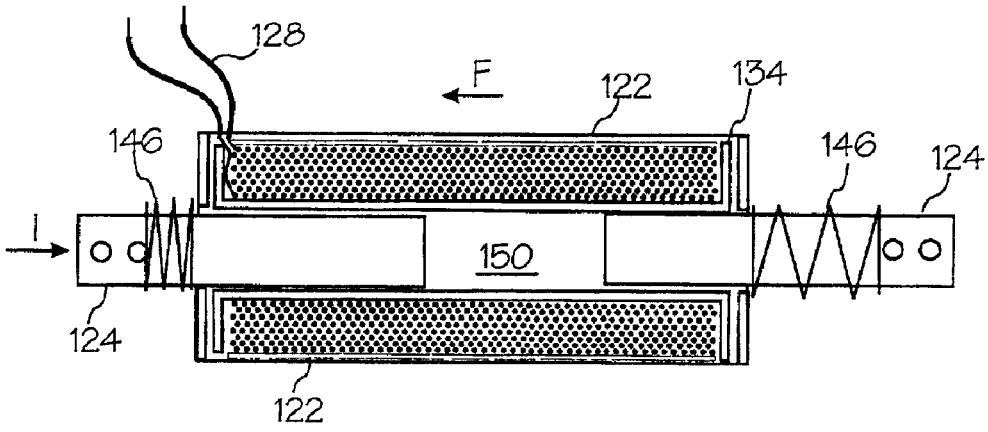
FIG. 16 illustrates the state of the embodiment shown in FIG. 12 after the external force has been removed.

FIG. 15 shows an alternative embodiment of solenoid 120 constructed with external springs 146 mounted coaxially around armatures 124. A check valve 154 equipped with a floating ball 156 on one of two vents 152 will allow the inertial force I applied to one of armatures 124 in response to an unauthorized application of a force F to casing 132 to restrict outflow of air from inertial portion 150 with the trapped air being instead applied, together with inertial force I, to force the opposite armature 124 to extend outwardly. In fact, the opposite armature is most likely nearly extended to its maximum stroke; the inertial force will therefore, simply maintain the extended armature within its conforming slot and prevent operation of the lock despite the application of force F. Check valve 154 will prevent the occurrence of a negative vacuum when the effect of force F is attenuated.

Figure 17:
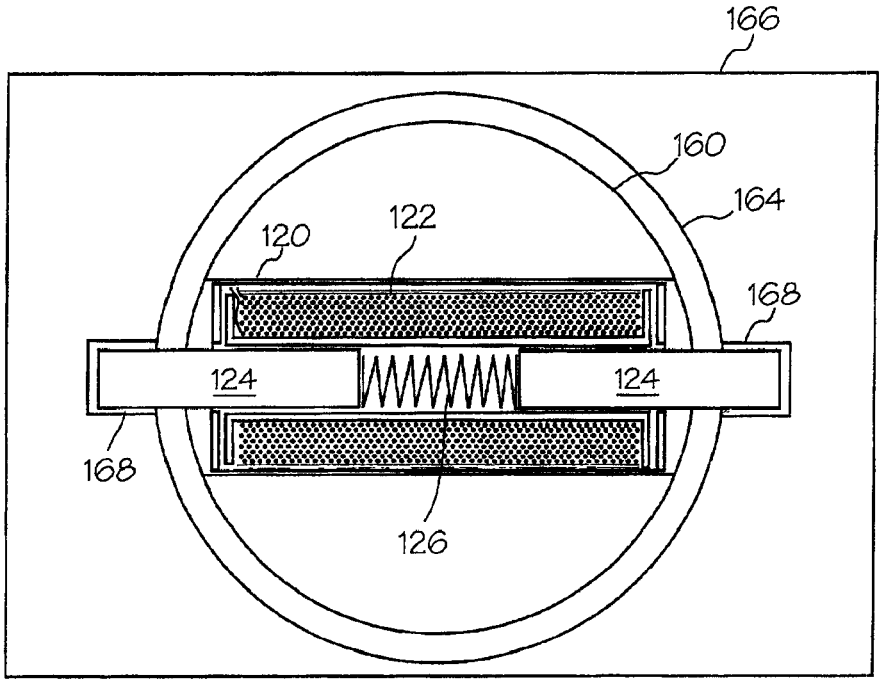
FIG. 17 illustrates a cylinder plug of a lock equipped with a dual armature solenoid shown in a first operational state.
Figure 18:
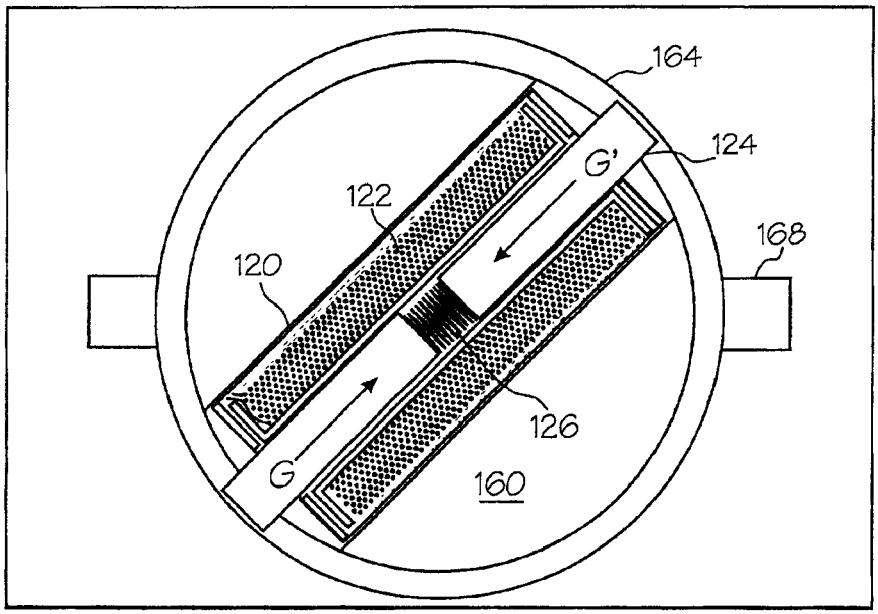
FIG. 18 illustrates a cylinder plug of a lock equipped with a dual armature solenoid shown in a second operational state.

FIGS. 17 and 18 show alterative embodiments incorporating solenoid 140 within the cylinder plug 160 of a lock. Cylinder plug 160 is coaxially inserted into the central bore 164 of the shell 144 of the lock. As shown in FIG. 7, when solenoid 120 is in an energized state, armatures 124 are forced radially outwardly by spring 126 to engage conforming slots 168 cut into the inertial circumferential surfaces of bore 134. When a potential difference is applied across leads 128 of coil 122 however, the resulting magnet field creates oppositely directed forces G, G' that draw the distal ends of armature 124 radially inwardly, thereby withdrawing the distal ends of armature 124 from slots 168, and thus allowing cylinder plug 160 to rotate, either clockwise or counter clockwise (depending upon the construction of the lock) relative to shell 166.

Figure 19:
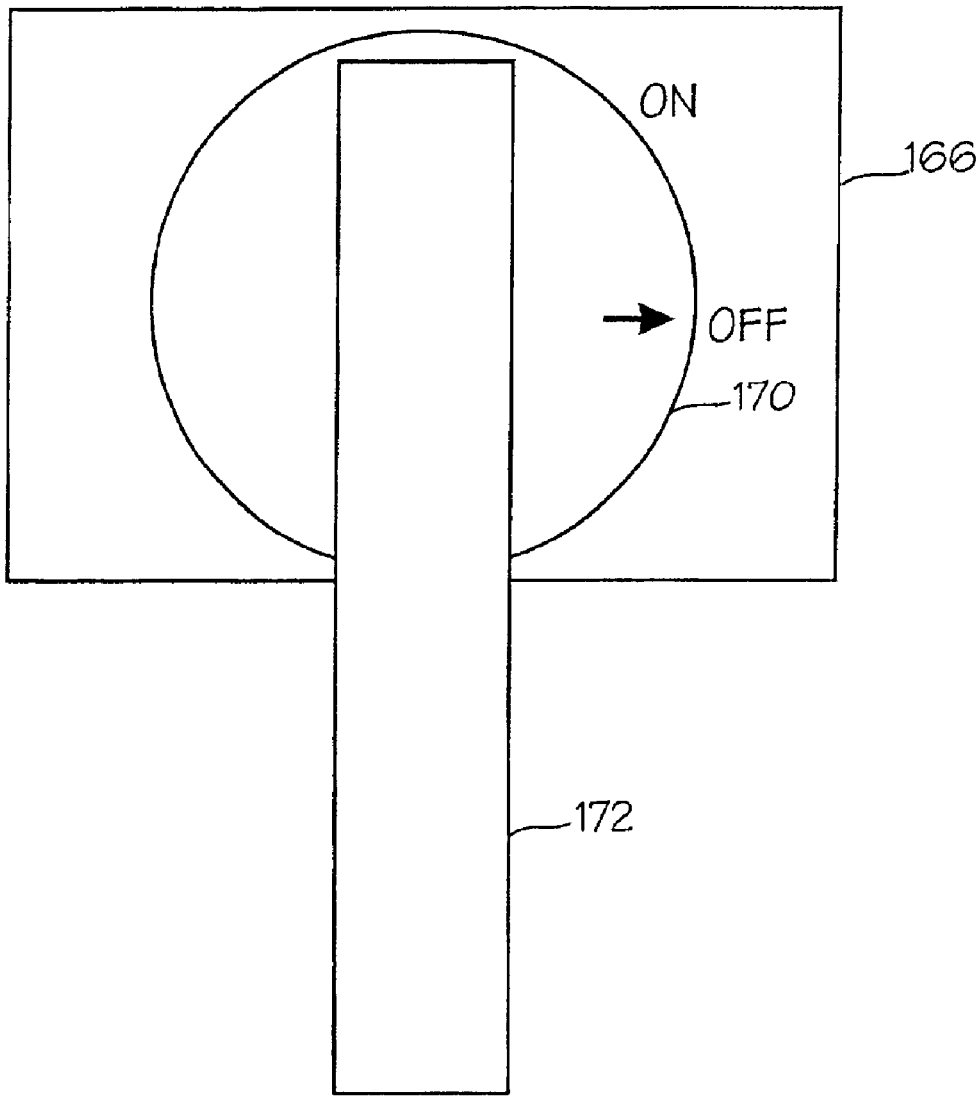
FIG. 19 illustrates a cam driven by the lock illustrated in FIG. 17.

FIG. 19 illustrates a cam 170 that may be formed at one axial end of cylinder 160, and a bolt 172 that may be operated (that is, either turned or alternatively, extended or retracted) by rotation of cam 170.

Figure 20:
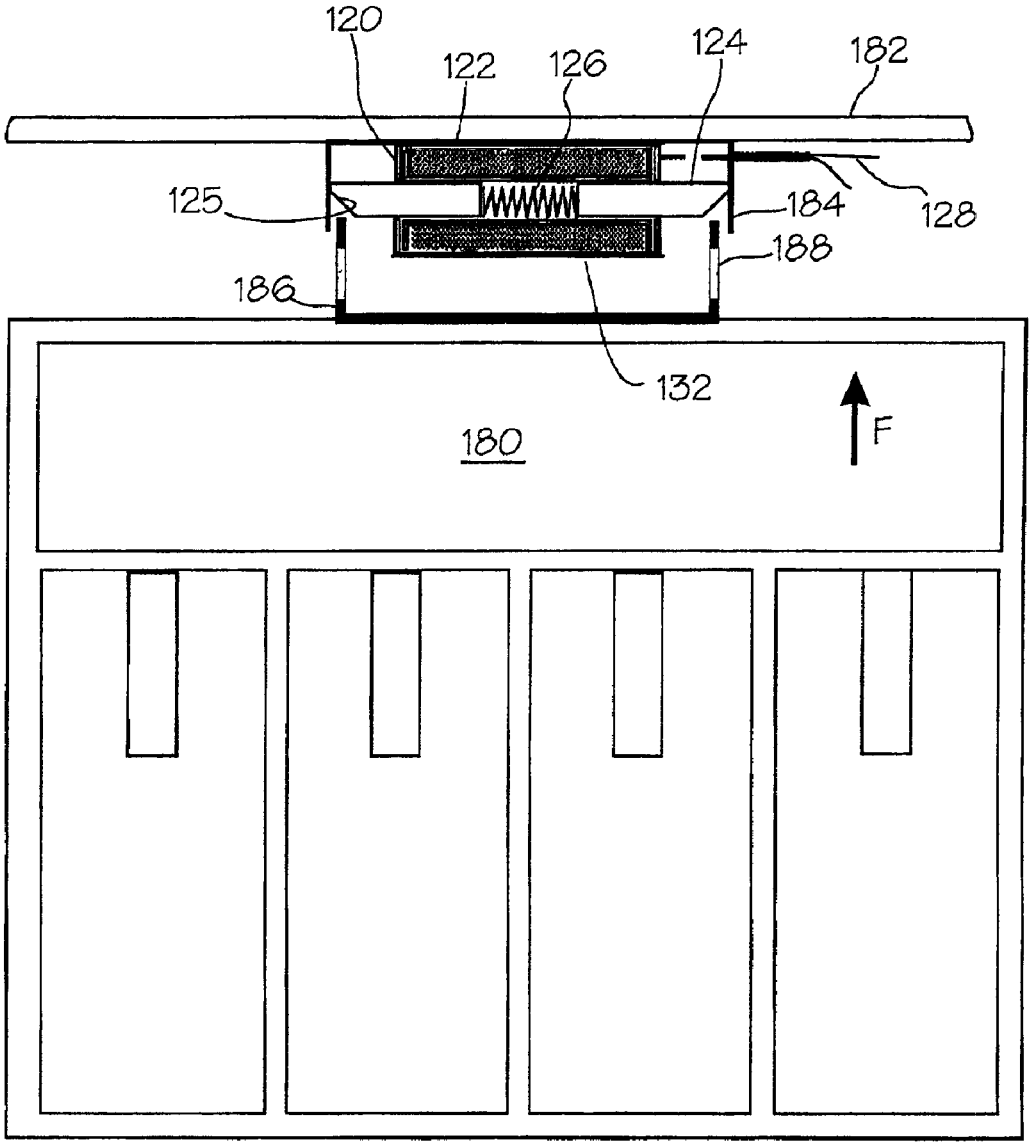
FIG. 20 illustrates a plan view of an alternative embodiment of the present invention.
Figure 21:
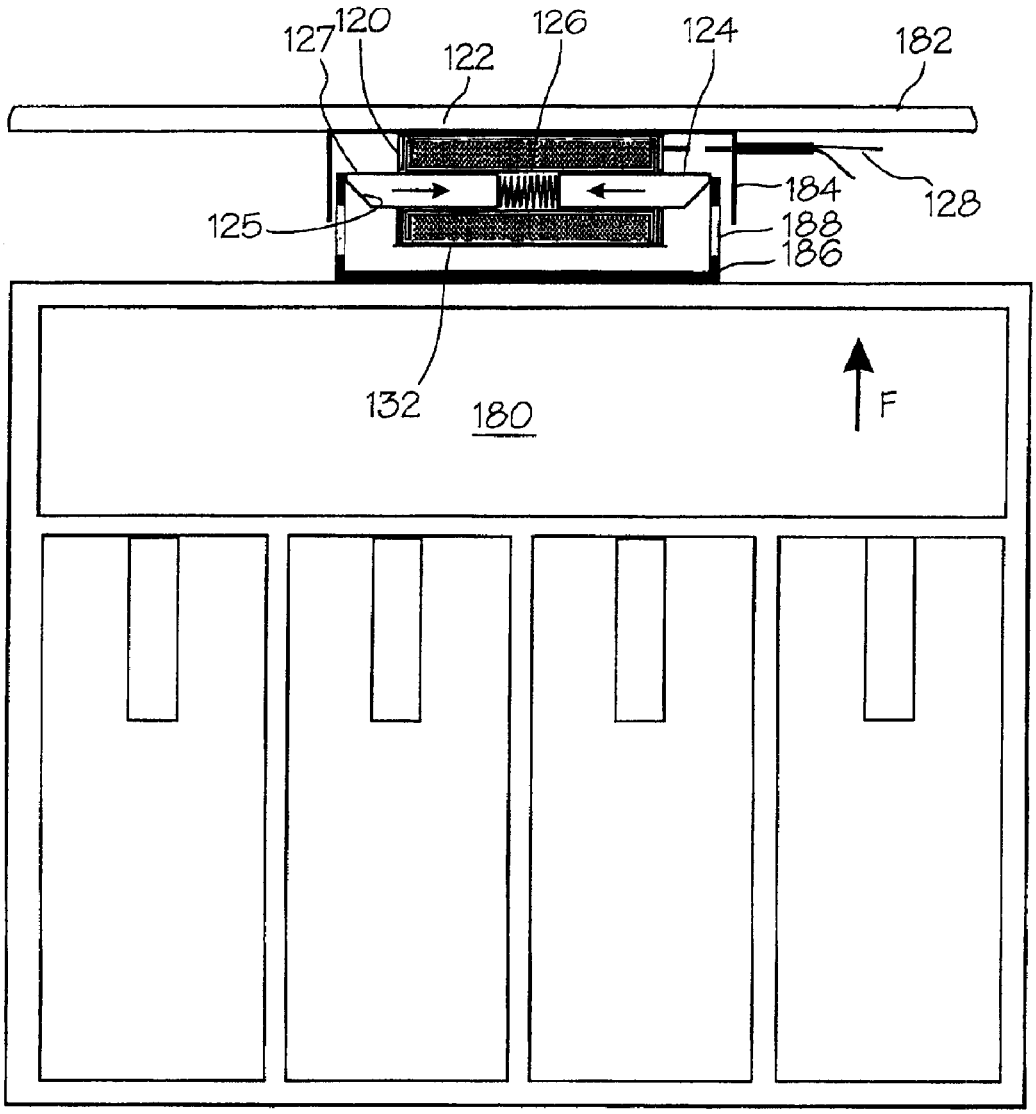
FIG. 21 illustrates the embodiment of FIG. 20 during transmission from one operational state to a second operational state.
Figure 22:
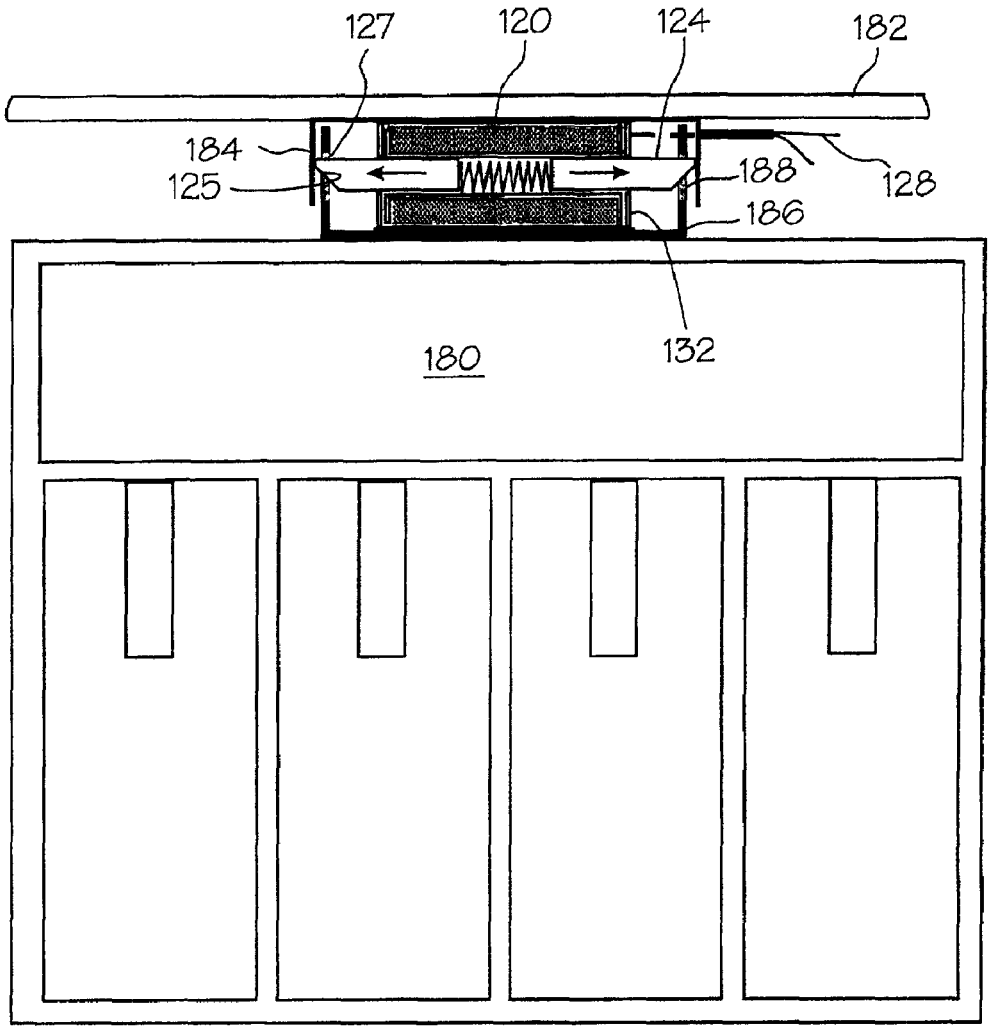
FIG. 22 illustrates the embodiment of FIG. 20 in a second operational state.

FIGS. 20, 21 and 22 show a lock equipped with a solenoid 120 fitted into a drawer 180. Solenoid 120 may be mounted within a bracket 184 against rear vertical wall 182 of drawer 180, on the inside of the drawer. Electrical leads 128 to circularly wound coil 122 may be supported by bracket 184. The distal base ends of armatures 124 are beveled to form camming surfaces 125. A second bracket 186 mounted on the vertical wall of cash register drawer 180 is perforated by axially opposite apertures 188 that are sized to receive the beveled distal ends 125 of armatures 124. Consequently, when drawer 180 is forced to the rear in the direction of arrow F, bracket 186 engages beveled ends 125 of armatures 124 and forces the distal ends of armatures 124 away from bracket 184, as shown in FIG. 20, until the extreme distal tips of armatures 124 engage the interior walls of bracket 184. Farther travel to the rear in the direction of force F as shown in FIG. 21 and subsequently in FIG. 22, will force the distal ends of apertures 124 within aperture 188 under the force applied by spring 126, thereby locking drawer 180 against rear wall 182. The presence of the circumferential surfaces 127 of distal ends of armatures 124 against the rear walls of apertures 188 will prevent drawer 180 from being opened, even minutely.

Subsequent application of a potential difference across leads 128 will cause current to flow through coil 122, thereby electrically creating a magnetic field that will generate oppositely directed forces that retract armatures 124 axially into the center 150 of axial bore 130 surrounded by coil 122. This will withdraw the distal ends of armatures 124 from apertures 188 and contemporaneously allow drawer 180 to be drawn outwardly with bracket 186 removed from between end walls 184, thereby allowing drawer 180 to remain open once the potential difference has been removed from across leads 128.

It may be seen from the foregoing paragraphs that the embodiments of the present invention provide an electromechanical release mechanism that protects the security provided by a lock equipped with a solenoid from deliberate application of external force applied to the lock in an effort to dislodge armatures 124 from engaging their corresponding slots 188 within the lock. The dimensions of the solenoid is quite small, thereby enabling the solenoid to be incorporated within the cylinder plugs of locks equipped with mechanical pin tumblers. The dimensions of the solenoid also enables the solenoid to be mounted to accommodate both radial and, in different embodiments, axial movement of the armatures relative to the housing, or shell of the lock.

Locks equipped with a dual armature solenoid may be employed as components of a system that uses a process for programming (i.e., in some instances a computer terminal), an optional key programming station, an electronic key, and an electronic cam. Generally, the foregoing paragraphs describe a lock that may be constructed with a housing bearing a hole centered upon a first axis, a bolt supported by the housing and moving transversely relative to the first axis to protrude beyond the housing to an extended position and to retract within the housing to a retracted position, a cylinder plug perforated by a keyway, having an exposed circumferential surface surrounding the keyway rotatably fitted within the hole, and rotating within the hole in response to rotational force applied by a key conformingly corresponding to the lock through an arc centered upon the first axis, a cam positioned to rotate with the cylinder plug as the key conformingly corresponding to the lock manually applies a rotational force to the cylinder plug rotates through a arc, a member eccentrically positioned relative to the axis, extending between the cam and the bolt to drive the bolt between the extended and the retracted positions as the cylinder plug turns through the arc, an electronic circuit containing a memory and a microprocessor, mounted upon and supported by the cam to rotate with the cam through the arc, the electronic circuit operationally responding to digital data carried by the key conformingly corresponding to the lock when the microprocessor determines that the digital data conformingly corresponds to resident data stored within the memory, a release spaced-apart from the cylinder and eccentrically positioned away from the first axis, the release being functionally activated by the electronic circuit to move between a deployed position preventing rotation of the cam relative to the housing, and a released position accommodating the rotation of the cam relative to the housing of the lock. By electrically energizing a release mechanism that is spaced-apart from the axis of rotation of the cylinder plug, the magnetic field created by the coil within its bore draws the armatures in opposite directions toward the centroid of the bore; consequently, both armatures move between a deployed position preventing rotation of the cam or cylinder plug of the lock relative to the housing, and a released position accommodating the rotation of the cam or the cylinder plug relative to the housing. It maybe appreciated therefore, that embodiments of mechanisms equipped the foregoing solenoids may be used to retrofit locks that are already installed, typically by simply replacing a single component of the lock.

What we claim is:

1. A lock, comprising:

a housing bearing an interior recess containing a pair of axially aligned and spaced apart detents, said housing being positionable to control access by alternately assuming a locked state and an unlocked state;

a mechanism removably intersertable within said recess, said mechanism comprising:

a single annularly wound coil of insulated wire forming a circular cylinder surrounding a central axially oriented bore, said wire terminating in a single pair of leads with axially opposite base ends of said coil being perforated by said bore;

a pair of armatures each exhibiting a distal end, said armatures being made of a material that is movably responsive to magnetic force, and being slidably positioned at axially opposite ends of said bore, in coaxially aligned axial opposition; and means coaxially aligned with said armatures, biasing both of said armatures to extend said distal ends axially outwardly beyond axially opposite base ends of said coil;

said housing holding said mechanism with said bore being axially aligned between said detents, with said detents providing simultaneous engagement of different ones of said distal ends and maintaining said locked state; and said distal ends both withdrawing axially away from said engagement and towards said bore to place said lock in said unlocked state in response to application of a potential difference across said pair of leads.

2. The lock of claim 1, further comprised of said coil forming an air vent extending between a central portion of said bore and an exterior surface of said mechanism.

3. The lock of claim 1, with said biasing means comprised of a spring interposed between said armatures within said bore.

4. The lock of claim 1, with said biasing means comprising:

a first spring interposed between said distal end of a first one of said armatures and one extremity of said coil, and a second spring interposed between said distal end of a second one of said armatures and an opposite extremity of said coil.

5. The lock of claim 3, further comprised of said coil forming an air vent extending between a central portion of said bore and an exterior surface of said mechanism.

6. The lock of claim 4, further comprised of said coil forming an air vent extending between a central portion of said bore and an exterior surface of said mechanism.

7. The lock of claim 1, further comprised of said housing providing a cavity having a longitudinal axis and an interior surface, and said detents comprising a plurality of slots formed within said interior surface on diametrically opposite sides of said interior surface.

8. The lock of claim 1, further comprised of:

said housing providing a cavity having a longitudinal axis and an interior surface, and said detents comprising a plurality of slots formed within said interior surface on diametrically opposite sides of said interior surface; and said mechanism comprising a cylinder plug removably receivable within said cavity to rotate about said longitudinal axis, with said coil and said armatures borne by said cylinder plug in radial alignment with said slots while said housing is in said locked state, and said distal ends being withdrawn from said slots while said housing is in said unlocked state.

9. The lock of claim 8, further comprised of said coil forming an air vent extending between a central portion of said bore and an exterior surface of said mechanism.

10. The lock of claim 8, further comprised of said distal ends being beveled.

11. The lock of claim 1, further comprised of:

said housing providing a first bracket having a pair of spaced-apart end walls forming a cavity having a longitudinal axis, and said detents comprising a plurality of apertures formed within said end walls on diametrically opposite sides of said cavity; and said mechanism comprising a second bracket bearing said coil and said armatures to be slidably received within said cavity between said end walls with said armatures being aligned with said longitudinal axis, with said distal ends engaging said end walls and said armatures being depressed into said bore until said housing is placed in said locked state when said armatures are in axial alignment with said apertures, said distal ends being withdrawn from said apertures and toward said bore while said housing is in said unlocked state.

12. The lock of claim 11, further comprised of said coil forming an air vent extending between a central portion of said bore and atmosphere.

13. The lock of claim 11, further comprised of said distal ends being beveled.

14. The lock of claim 13, further comprised of said coil forming an air vent extending between a central portion of said bore and atmosphere.

15. A lock, comprising:

a housing bearing an interior recess containing a pair of spaced apart detents, said housing being positionable to control access by alternately positioning said detents in a locked state and an unlocked state; and a single annularly wound electrically conducting coil terminated by a single pair of leads; and a pair of armatures made of a material that is movably responsive to magnetic force, being slidably positioned to axially reciprocate relative to opposite ends of said coil between said detents, with one or both of said armatures maintaining said locked state by engaging corresponding ones of said detents, and placing said lock in said unlocked state in response to application of a potential difference across said pair of leads.

16. The lock of claim 15, further comprised of said coil forming an air vent extending between a central portion of said bore and an exterior surface of said mechanism.

17. The lock of claim 15, further comprised of said coil forming an air vent extending between a central position of said coil.

18. The lock of claim 15, further comprised of said housing providing a cavity having a longitudinal axis and an interior surface, and said detents comprising a plurality of slots formed within said interior surface on diametrically opposite sides of said interior surface.

19. The lock of claim 15, further comprised of:

said housing providing a cavity having a longitudinal axis and an interior surface, and said detents comprising a plurality of slots formed within said interior surface on diametrically opposite sides of said interior surface; and a cylinder plug removably receivable within said cavity to rotate about said longitudinal axis, with said coil and said armatures rotatably borne by said cylinder plug in radial alignment with said slots while said housing is in said locked state, and said armatures being withdrawn from said slots while said housing is in said unlocked state.

20. The lock of claim 15, further comprised of:

said housing providing a first bracket having a pair of spaced-apart end walls forming a cavity having a longitudinal axis, and said detents comprising a plurality of apertures formed within said end walls on diametrically opposite sides of said cavity; and a second bracket bearing said coil and said armatures to be slidably received within said cavity between said end walls with said armatures being aligned with said longitudinal axis, with distal ends of said armatures engaging said end walls and said armatures being depressed into said bore until said housing is placed in said locked state when said armatures are in axial alignment with said apertures, said distal ends being withdrawn from said apertures and toward said bore while said housing is in said unlocked state.

21. A lock, comprised of:

a solenoid comprising:

an electrically conducting coil conducting an electrical current around a bore; and a plurality of armatures positioned to exhibit a response to conduction of an electrical current by said coil;

a first one of said plurality of armatures being coaxially aligned within said bore with a second one of said plurality of armatures to exhibit an increased outward force axially away from said coil when an inward force directed axially toward said coil is applied to said second one of said plurality of armatures during an absence of said conduction.

22. A lock, comprised of:

a coil disposed to conduct an electrical current around a bore; and a plurality of armatures positioned in coaxial alignment within said bore to operatively respond to conduction of said electrical current by said coil, with a first one of said plurality of armatures being biased outwardly and away from said coil when a force biasing a second one of said armatures inwardly toward said coil is applied to said second one of said armatures during an absence of said conduction.

23. The lock of claim 10, further comprised of a check valve operationally controlling passage of air via said air vent.

24. The lock of claim 13, further comprised of:

said lock providing a vent extending between said bore and an exterior of said housing; and a check valve operationally controlling passage of effluent via said vent.

25. The lock of claim 19, further comprised of:

said lock providing a vent extending between said bore and an exterior of said housing; and a check valve operationally controlling passage of effluent via said vent.

26. The lock of claim 20, further comprised of:

said lock providing a vent extending between said bore and an exterior of said housing; and a check valve operationally controlling passage of effluent via said vent.

27. The lock of claim 21, further comprised of:

said lock providing a vent extending between said bore and an exterior of said housing; and a check valve operationally controlling passage of effluent via said vent.

28. The lock of claim 15, further comprised of:

said detents being coaxially aligned and spaced apart at least one deformable member positioned to bias distal ends of said armatures to reciprocate axially relative to axially opposite base ends of said coil; and said housing holding said coil aligned between said detents to accommodate relative movement of said coil between alignment of corresponding ones of said armatures and said detents as said lock alternates between said locked state and said unlocked state.

29. A lock comprised of:

a housing bearing an interior recess containing coaxially aligned and spaced apart detents, said housing being positionable to control access by alternately assuming a locked state and an unlocked state;

an electrically conducting coil forming a bore, said coil terminating in a single pair of electrical leads with axially opposite base ends of said coil being perforated by said bore;

a plurality of armatures each exhibiting a distal end, and being slidably positioned at axially opposite ends of said bore, in coaxially aligned radial opposition;

a member biasing said armatures to reciprocate through said bore; and said housing holding said core with said bore being axially aligned between said detents, to accommodate interaction between different corresponding ones of said distal ends and said detents alternating between said locked state and said unlocked state.

30. The lock of claim 22, further comprised of:

a housing bearing an interior recess containing a pair of axially aligned and spaced apart detents, said housing being positionable to control access by alternately assuming a locked state and an unlocked state;

said coil comprised of electrically insulated wire surrounding said bore, said wire terminating in a single pair of leads;

said armatures each exhibiting a distal end and being made of a material that is movably responsive to magnetic force, and being slidably positioned at axially opposite ends of said bore, in coaxially aligned radial opposition; and at least one deformable member biasing said armatures to reciprocate said distal ends axially through said opposite base ends of said coil; and said housing holding said coil with said bore being axially aligned between said detents, to accommodate interaction between different corresponding ones of said distal ends and said detents alternating between said locked state and said unlocked state.

31. The lock of claim 28, further comprised of:

said lock providing a vent extending from between said pair of armatures; and a check valve operationally controlling passage of effluent via said vent.

32. The lock of claim 29, further comprised of:

said lock providing a vent extending from said bore; and a check valve operationally controlling passage of effluent via said vent.

33. The lock of claim 30, further comprised of:

said lock providing a vent extending from said bore; and a check valve operationally controlling passage of effluent via said vent.

34. A lock, comprised of:

an assembly comprising a first structure movably embracing a second structure;

one of said first structure and said second structure bearing at least one detent;

a second of said first structure and said second structure bearing a solenoid providing a bore and a plurality of armatures positioned to exhibit a response to conduction of an electrical current by said coil, with a first one of said plurality of armatures being aligned with a second one of said plurality of armatures to exhibit an increased outward force axially away from said coil when an inward force directed axially toward said coil is applied to said second one of said plurality of armatures during an absence of said conduction.

35. The lock of claim 34, comprised of said plurality of armatures being coaxially aligned within said bore.

36. A lock, comprised of:

a housing bearing at least one detent;

an insert movable received within said housing, said insert bearing;

a solenoid surrounding a bore; and a plurality of armatures positioned in axial opposition within said bore to exhibit axially opposite movement relative to said bore in response to flow of an electrical current through said coil;

with said insert engaging said detent and obstructing movement of said insert relative to said housing in dependence upon said flow.

37. The lock of claim 36, comprised of said plurality of armatures being coaxially aligned within said bore.

38. A lock, comprising:

a single annularly wound electrically conducting coil terminated by a single pair of leads;

a housing containing a pair of spaced apart detents, said housing being positionable to control access by alternately engaging said detents in a locked state and an unlocked state; and a pair of armatures slidably positioned to axially reciprocate between said detents, with one or both of said armatures maintaining said locked state by engaging corresponding ones of said detents, and placing said lock in said unlocked state in response to application of a potential difference across said pair of leads.

* * * * *